US009134073B2

(12) United States Patent
Malugani et al.

(10) Patent No.: US 9,134,073 B2
(45) Date of Patent: Sep. 15, 2015

(54) HEAT EXCHANGER WITH WELDED PLATES

(75) Inventors: Gérard Malugani, Grenoble (FR); Jean-Michel Cadoret, Congis-sur-Therouanne (FR)

(73) Assignee: VITHERM, Meylan (FR)

( * ) Notice: Subject to any disclaimer, the term of this patent is extended or adjusted under 35 U.S.C. 154(b) by 771 days.

(21) Appl. No.: 13/139,631

(22) PCT Filed: Dec. 15, 2009

(86) PCT No.: PCT/FR2009/052531

§ 371 (c)(1),
(2), (4) Date: Sep. 16, 2011

(87) PCT Pub. No.: WO2010/076477

PCT Pub. Date: Jul. 8, 2010

(65) Prior Publication Data

US 2012/0000633 A1 Jan. 5, 2012

(30) Foreign Application Priority Data

Dec. 15, 2008 (FR) ..... 08 58570

(51) Int. Cl.
*F28D 9/00* (2006.01)
*F28F 3/08* (2006.01)
*F28F 9/00* (2006.01)

(52) U.S. Cl.
CPC ..... *F28D 9/0037* (2013.01); *F28F 3/08* (2013.01); *F28F 9/001* (2013.01); *F28F 2275/14* (2013.01); *Y10T 428/24479* (2015.01)

(58) Field of Classification Search
CPC .... F28D 9/0037; F28F 9/182; F28F 2275/14; F28F 2275/16; F28F 9/001; F28F 9/005; F28F 2220/00; F28F 2225/02; F28F 2280/02; F28F 2280/06; F28F 3/00; F28F 3/005; B23P 15/26; B21D 53/04
USPC ..... 165/78, 82, 166, DIG. 356, DIG. 366, 165/DIG. 370, DIG. 371, DIG. 373, 157, 76; 211/41.18, 134, 191
See application file for complete search history.

(56) References Cited

U.S. PATENT DOCUMENTS 2,985,433 A * 5/1961 Simpelaar ..... 165/166
3,866,674 A * 2/1975 Tramuta et al. ..... 165/166

(Continued)

FOREIGN PATENT DOCUMENTS

DE 605 980 C 11/1934
DE 39 24 581 A1 1/1991

(Continued)

OTHER PUBLICATIONS

International Search Report, Apr. 13, 2010, from International Phase of the instant application.

*Primary Examiner* — Judy Swann
*Assistant Examiner* — John Higgins
(74) *Attorney, Agent, or Firm* — Pearl Cohen Zedek Latzer Baratz LLP

(57) ABSTRACT

The invention relates to a heat exchanger, comprising a closed chamber in which are arranged ribbed welded plates (40) defining therebetween independent and mutually penetrating circuits in which fluids flow, the side walls defining said chamber being attached onto vertical rails, characterized in that said plates comprise at each angle an edge (41) that fits into apertures formed on vertical angle corners (60), said rails being inserted into said corners. The use of angle corners for receiving the edges of the plates improves the assembly and the retention of the plates therebetween.

18 Claims, 9 Drawing Sheets

(56) References Cited

U.S. PATENT DOCUMENTS

| | | | | | |
|---|---|---|---|---|---|
| 4,298,059 | A | * | 11/1981 | Krauth et al. | 165/166 |
| 4,378,837 | A | * | 4/1983 | Ospelt | 165/166 |
| 4,609,039 | A | * | 9/1986 | Fushiki et al. | 96/126 |
| 4,719,970 | A | * | 1/1988 | Fayolle | 165/166 |
| 5,072,790 | A | | 12/1991 | Lapowsky | |
| 5,228,515 | A | | 7/1993 | Tran | |
| 6,059,025 | A | * | 5/2000 | Hossfeld | 165/166 |
| 7,740,056 | B2 | * | 6/2010 | Watanabe | 165/166 |
| 2010/0012303 | A1 | * | 1/2010 | Domen | 165/166 |

FOREIGN PATENT DOCUMENTS

| | | | |
|---|---|---|---|
| EP | 0 307 298 | A1 | 3/1989 |
| EP | 0 443 299 | A1 | 8/1991 |
| EP | 0 566 208 | A1 | 10/1993 |
| FR | 2 562 997 | A1 | 10/1985 |
| JP | 51 098650 | A | 8/1976 |
| WO | WO 93/22608 | A1 | 11/1993 |

* cited by examiner

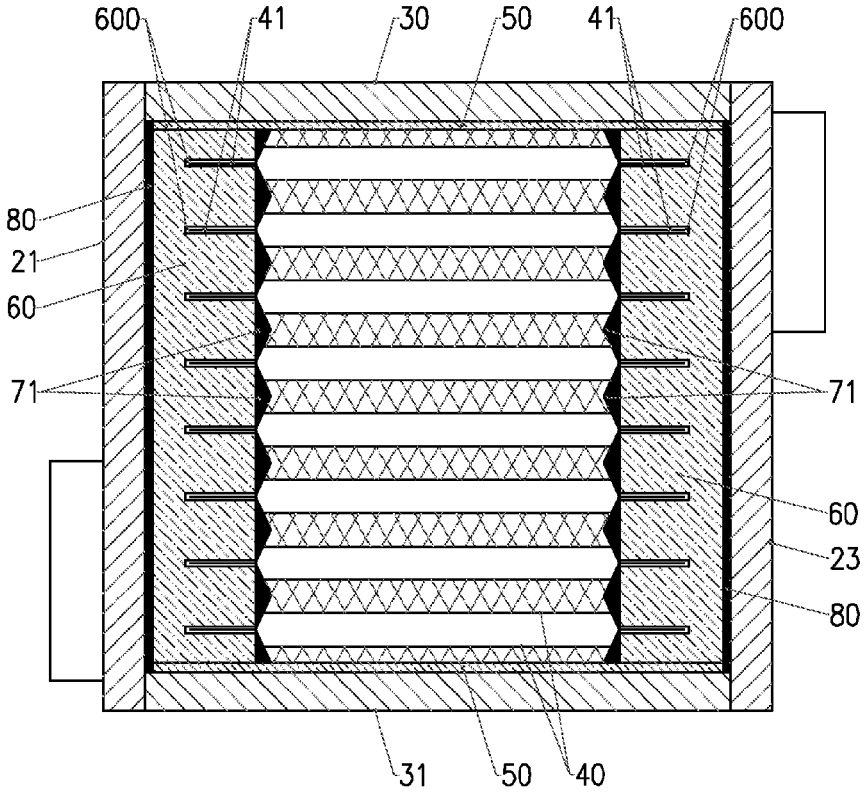
Fig. 7 (A–A)

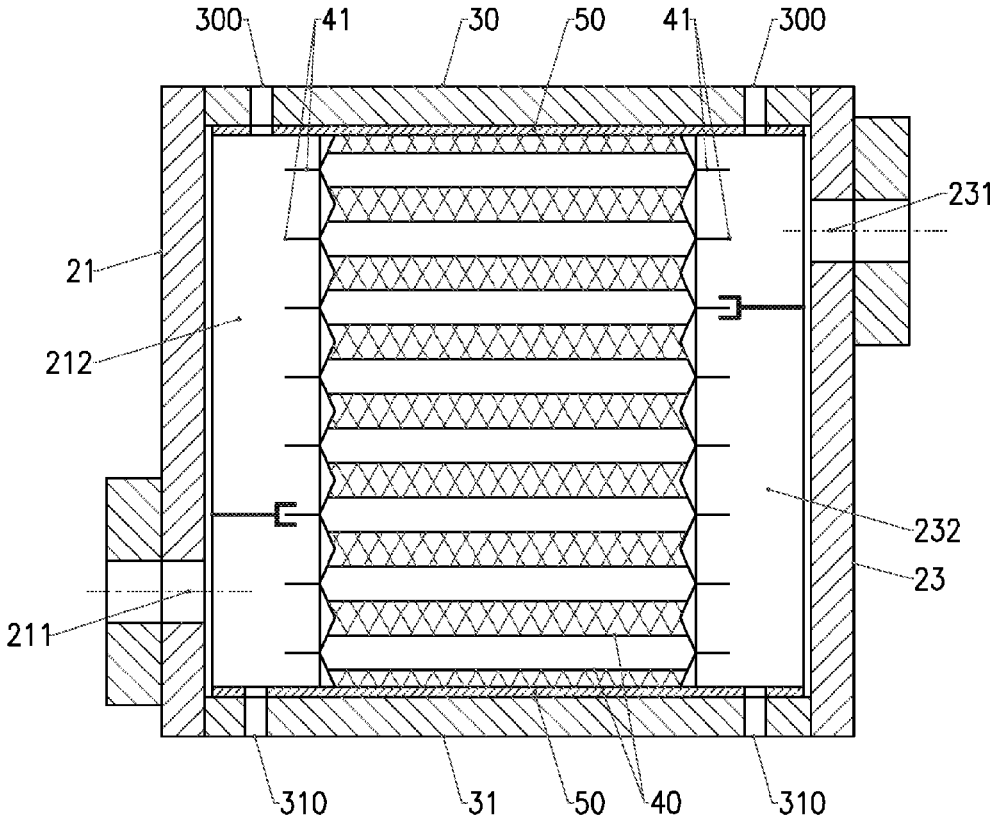
Fig. 8 (B–B)

HEAT EXCHANGER WITH WELDED PLATES

CROSS REFERENCE TO RELATED APPLICATIONS

This application is a national phase Application of PCT International Application No. PCT/FR2009/052531, entitled "HEAT EXCHANGER WITH WELDED PLATES", International Filing date Dec. 15, 2009, published on Jul. 8, 2010 as International Publication No. WO 2010/076477, which in turn claims priority from French Patent Application No. 0858570, filed Dec. 15, 2008.

TECHNICAL FIELD OF THE INVENTION

The subject of the invention is a heat exchanger with welded plates. It also relates to a plate intended to be used in this exchanger.

The invention relates to the technical field of heat exchangers produced by the juxtaposition of plates welded together and defining interpenetrating cold and hot fluid circuits.

STATE OF THE ART

Plate heat exchangers are well known to those skilled in the art. These exchangers generally provide for the transfer of cold or heat between a cold fluid and a hot fluid, without said fluids coming into contact. For example, these exchangers can be used to provide for steam condensation by contact with a cold source. Such exchangers are, for example, disclosed in the patent documents WO 93/22608 (FERNANDEZ) and FR 2.562.997 (VICARS).

The exchanger described in the document WO 93/22608 (FERNANDEZ) comprises (the references between brackets relate to that document) a closed chamber inside which are arranged ribbed welded plates (1, 18, 19) defining between them interpenetrating independent circuits in which fluids are intended to flow. The plates (1, 18, 19) are welded pairs in cassette form. The side walls (39) delimiting the chamber are fixed to vertical rails (10) inserted into gutters (16). In a first embodiment, the plates (1) are directly welded to one face of the gutters (16). In a second embodiment, the plates (18, 19) are welded to openings (25) formed on a vertical wall (24) joining two gutters (16).

The method for fixing the plates (1, 18, 19) described in the document WO 93/22608 (FERNANDEZ) includes a certain number of drawbacks. In the first embodiment, there are significant assembly constraints because the plates (1, 18, 19) must be perfectly positioned on the gutters (16) and be welded with high accuracy. Furthermore, the welds absorb all the mechanical stresses and significant heat expansions, so that these welds can quickly break and lead to seal-tightness problems (and therefore a drop in the efficiency of the exchanger) between the two fluid circuits. Furthermore, these welds are exposed directly to the fluids flowing in the appliance. In the second embodiment, the use of the vertical walls (24) unnecessarily increases the bulk of the chamber.

The document FR 2.562.997 (VICARB) describes an exchanger (the references between brackets apply to that document) consisting of ribbed plates (20) stacked inside a closed chamber. These plates (20) are maintained juxtaposed one above the other by welding and stiffened using four rigid longitudinal rails (3) supporting the side walls (5, 6, 7, 8) of the chamber. These side walls form (5, 6, 7, 8), in association with the rails (3), independent chambers for each of the fluids. Each plate (20) has ribs configured to form, when they are stacked, independent and interpenetrating ducts, in which the hot and cold fluids flow. The plates (20) include, in each corner, a vertical edge (25, 26, 27, 28) enabling them to be fixed, by welding, to the rails (3).

The method for fixing the plates (20) described in the document FR 2.562.997 (VICARB) also has a number of drawbacks. The first is that the formation of the vertical edges (25, 26, 27, 28) requires a specific stamping of the plates (20) performed so that the lips are turned back alternately in reverse 90° directions to form said edges. This particular shape makes the welding together of the plates (20) complex. A second drawback lies in the fact that the plates (20) need to have limited surface areas (in practice, at best 75 cm×75 cm) so that said plates and the side walls (5, 6, 7, 8) of the chamber are not subjected to an excessive pressure which would risk degrading the stiffness and mechanical strength of the exchanger. Another major drawback lies in the fact that the link between the vertical edges (25, 26, 27, 28) and the rails (3) is subject to significant mechanical stresses and heat expansions, so that these links can quickly break and lead to seal-tightness problems (and therefore a drop in the efficiency of the exchanger) between the two fluid circuits.

Given these factors, the main technical problem that the invention aims to resolve is how to improve the assembly and securing of the plates inside the chamber.

Another objective of the invention is to propose a heat exchanger that makes the design simpler than that of the exchangers known from the prior art.

Yet another objective of the invention is to propose an exchanger that can have an exchange surface area greater than that of the exchanger described in the patent document FR 2.562.997 (VICARB), while ensuring the rigidity of the plates and the mechanical strength of the assembly.

DISCLOSURE OF THE INVENTION

The solution proposed by the invention is a heat exchanger comprising a closed chamber inside which are arranged ribbed welded plates defining between them interpenetrating independent circuits in which fluids are intended to flow; the side walls delimiting said chamber being fixed to vertical rails, the latter being inserted into said angle irons. The exchanger that is the subject of the invention is noteworthy in that the plates include, in each corner, an edge that fits into openings formed on vertical angle irons.

The use of angle irons adapted to receive the edges of the plates makes it possible to improve the assembly and securing together of said plates. In practice, fitting the plates into the openings of the angle irons, which are independent of the rails, is simpler than welding said plates directly to said rails. Furthermore, the assembly constraints are reduced since, in the prior art, the rails have to receive not only the plates, but also the side walls forming the chamber. It is now the angle irons, and no longer the rails, that ensure the segregation of the fluids between the two circuits. Furthermore, the thermal and mechanical stresses are now applied at the level of the openings of the angle irons which can absorb significant expansions and pressures, without damaging the seal-tightness of the assembly. Another advantage resulting from the invention is that the angle irons now provide cladding and protection for the rails, which simplifies the design and improves the rigidity and the mechanical strength of the exchanger.

Another aspect of the invention relates to plates intended to be used in the exchanger conforming to the characteristics described previously.

DESCRIPTION OF THE FIGURES

Other advantages and characteristics of the invention will become more apparent from reading the following description of a preferred embodiment, with reference to the appended drawings, given as indicative and nonlimiting examples and in which:

FIG. 7 is a cross-sectional view according to A-A of the exchanger of FIG. 4, FIG. 8 is a cross-sectional view according to B-B of the exchanger of FIG. 4, FIGS. 9*a* to 9*d* are top views of different embodiments of plates that can be used in the exchanger that is the subject of the invention.

EMBODIMENTS OF THE INVENTION

The heat exchanger that is the subject of the invention is of the type comprising a closed chamber inside which are arranged ribbed plates defining between them interpenetrating independent circuits in which fluids are intended to flow, the side walls delimiting said chamber being fixed to vertical rails. This type of exchanger is of the type known to those skilled in the art.

Figure 2:
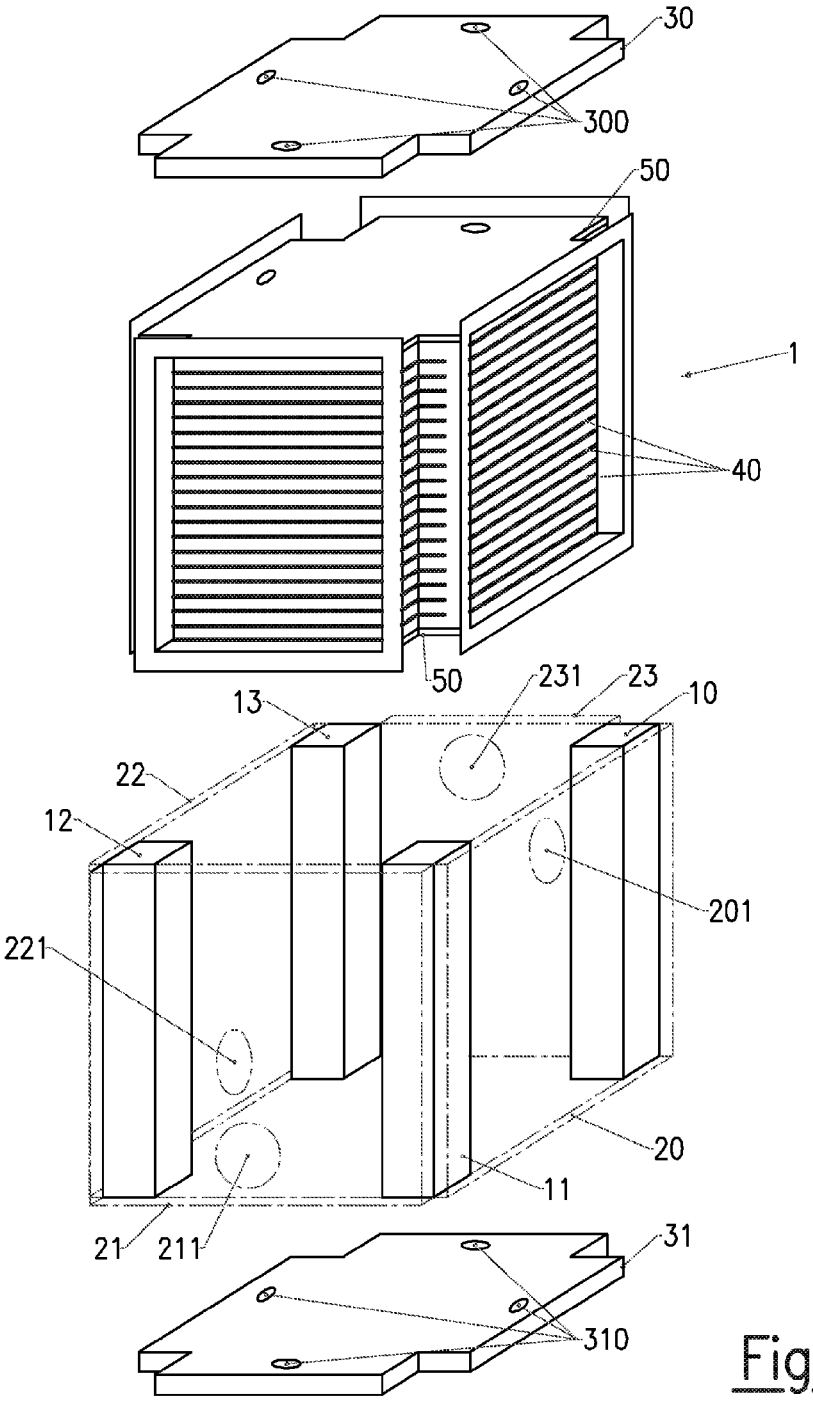
FIG. 2 is a perspective schematic view showing in an exploded manner the arrangement of various constituent elements of an exchanger conforming to the invention.

Referring to the appended figures and in particular to FIGS. 2, 3, 4, 7 and 8, the exchanger has a general parallelepipedal shape with dimensions mainly dependent on the number of stacked plates and the dimensions thereof. Referring to FIG. 2, this exchanger comprises one (or more) modules 1 of plates 40 juxtaposed in roughly parallelepipedal shape, inserted on four vertical rails 10 arranged at the four corners. The number of modules 1 used is dependent on the flow rate of the fluids to be handled. The rails 10 appear in the form of metal poles, hollow or solid, of substantially rectangular section with dimensions that are variable according to the service pressure, for example approximately 10 cm×10 cm. Their length corresponds substantially to the height of the module or modules 1.

Figure 3:
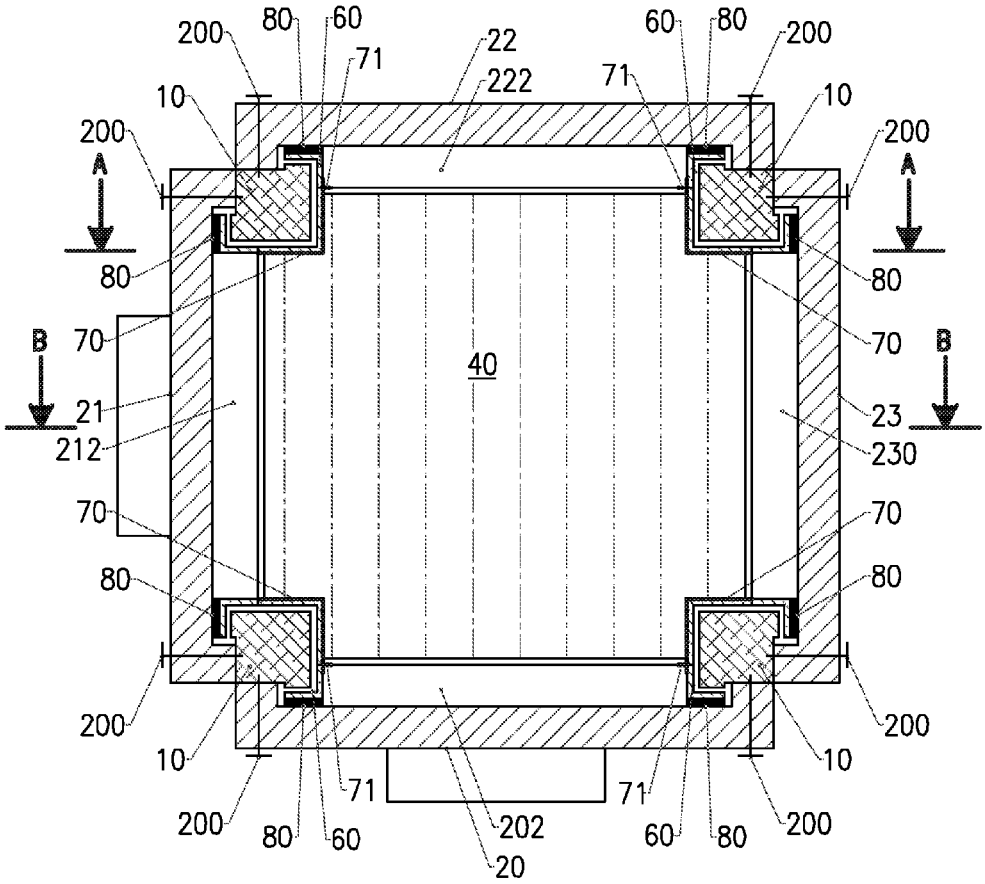
FIG. 3 is a horizontal cross-sectional view of an exchanger conforming to the invention.

Side walls 20, 21, 22, 23 are fixed to the vertical rails 10 so as to form a chamber around the module 1. These side walls 20, 21, 22, 23 are preferentially metal panels from a few millimeters to a few centimeters thick depending on the pressures of the fluids flowing in the exchanger. As diagrammatically represented in FIGS. 3 and 4, the walls 20, 21, 22, 23 are advantageously fixed to the rails 10 by means of screws 200, bolts, or in any other manner agreeable to those skilled in the art. Referring to FIG. 3, the side walls 20, 21, 22, 23 form, in association with the rails 10 and the module 1, independent lateral chambers, respectively 202, 212, 222, 232, in which the fluids flow. In the exemplary embodiment represented in FIG. 3, a first fluid will flow through the module 1, between the chamber 202 and the chamber 222 and the second fluid will flow through the module 1, between the chamber 212 and the chamber 232. However, other directions of circulation agreeable to those skilled in the art can be envisaged depending on the fluids to be handled.

Referring to FIGS. 2, 3, 4, 7 and 8, each of the walls 20, 21, 22, 23 is provided with an orifice, respectively 201, 211, 221, 231, intended for the passage of a duct connecting the inlet and the outlet of each; for the fluids flowing in the exchanger. In a variant embodiment that is not represented, it is possible for a wall to be provided with both the inlet and the outlet for a first fluid and for another wall to be provided with the inlet and the outlet for the second fluid, the other walls not having any orifice.

The chamber of the exchanger is provided with a top cover 30 and a bottom 31 cooperating in a seal-tight manner with the side walls 20, 21, 22, 23, to close said chamber. According to an advantageous characteristic of the invention, the cover 30 is equipped with orifices 300 for bleeding air and the bottom 31 is equipped with orifices 310 for bleeding fluids. In practice, the orifices 300 of the cover 30 are positioned facing the lateral chambers 202, 212, 222, 232 so that the air can be correctly expelled from the latter when filling the exchanger. Similarly, the orifices 301 of the bottom 31 are also positioned facing the lateral chambers 202, 212, 222, 232 so that the fluids can flow totally out of the latter when bleeding the exchanger.

Figure 1A:
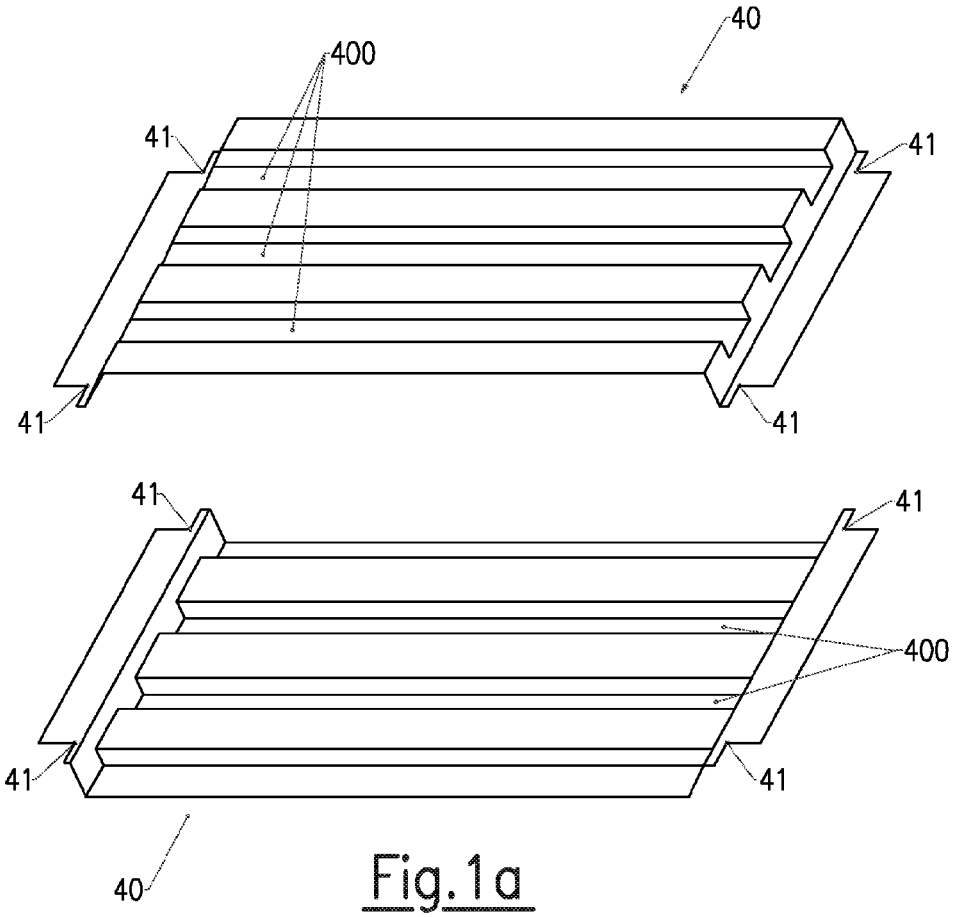
FIG. 1*a* is a perspective schematic view of two plates conforming to the invention and intended to be juxtaposed one on top of the other.
Figure 1B:
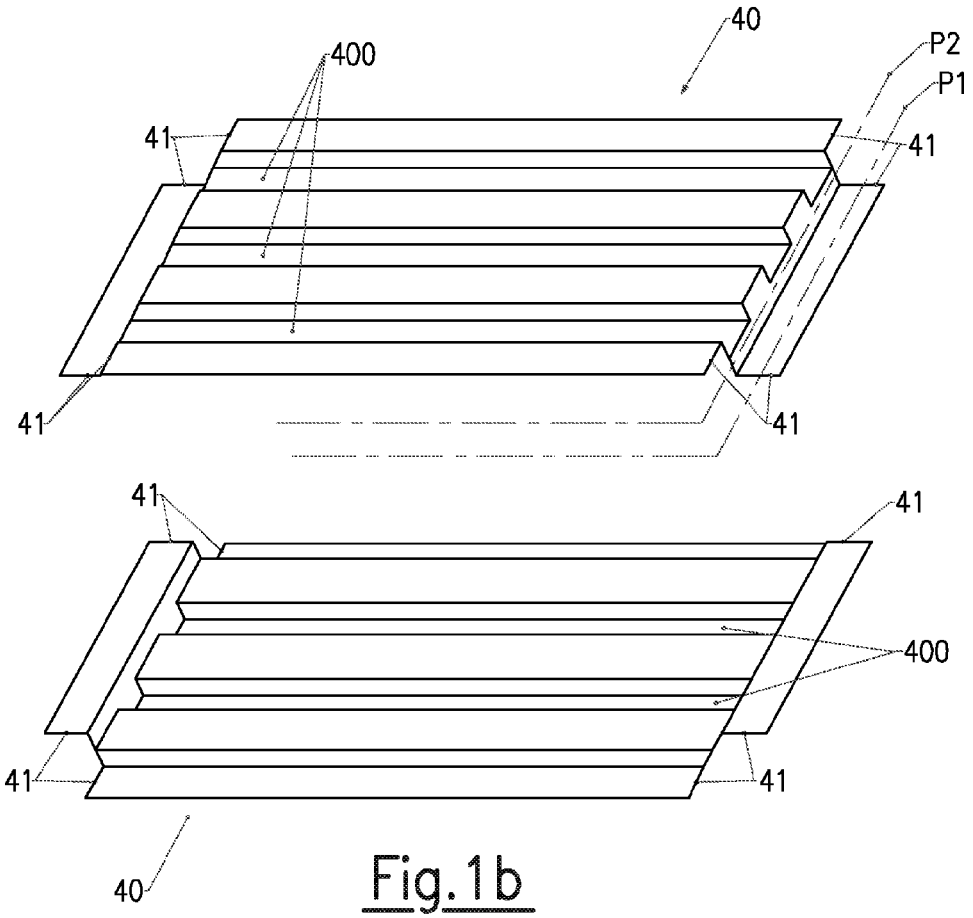
FIG. 1*b* is a perspective schematic view of two plates conforming to the invention in a variant embodiment and intended to be juxtaposed one on top of the other.

In a manner well known to those skilled in the art, the module 1 is produced using ribbed plates 40, superposed and alternated, in the manner of a millfoil. Referring to FIGS. 1*a* and 1*b*, 1, each plate 40 has ribs 400 configured so as to form, when the plates are stacked, independent and interpenetrating ducts, in which the hot and cold fluids flow. The geometry of the ribs 400 is well known to those skilled in the art and will not be described in more detail in the present description. The plates 400 are of generally rectangular or square shape. Their number is dependent on the service conditions and their dimensions vary from 20 cm×20 cm to 2 m×2 m, or even greater. For significant flow rates and high calorific powers, a number of modules 1 of plates 40 will be arranged in parallel. In practice, the plates 40 are produced from stampable metals such as: stainless steel, titanium, nickel, Hastellogs®, etc. They are welded alternately so as to alternately form open faces and closed faces.

In accordance with the invention and referring to FIGS. 1*a* and 9*a* to 9*d*, the plates 40 comprise, in each corner, an edge 41, preferentially horizontal. This horizontal edge 41 may be bracket shaped (for example L or V shaped) oriented toward the interior of the plate 40 (FIGS. 9*a* and 9*d*), be bevel-shaped (FIG. 9*b*) or have a circular shape oriented toward the interior of said plate (FIG. 9*c*), or any other shape agreeable to those skilled in the art. Their width varies, in practice, from a few millimeters to a few centimeters, their thickness being that of the plates 40. The edges 41 can easily be obtained when stamping the plates 40. These edges 41 may be located only at the corners of the plates 40 or be extended over opposite lips of said plates, or even be present over their entire periphery.

Referring to a variant embodiment represented in FIG. 1*b*, the edges 41 have their lips offset in space, that is to say that the lips are in two different planes, but parallel. For example, referring to the plate 40 at the top of FIG. 1*b*, a first lip of the edges 41 is in a first plane P1 situated below the ribs 400 and the second lip, perpendicular to said first lip, is in a second plane P2 situated above said ribs.

Referring to FIGS. 3 to 7, the horizontal edges 41 are intended to fit into horizontal openings 600 formed on the vertical angle irons 60. The vertical rails 10 are then inserted into these angle irons 60. Referring more particularly to FIGS. 5*a*, 5*b* and 5*c*, these angle irons are in the form of one-piece metal profile sections, for example obtained by bending or stamping, and having a central portion whose shape roughly corresponds to the general shape of the edges 41, that is to say, having a bracket, bevel or circular shape or similar. The horizontal openings 600 are formed at the level of the angular (or beveled or circular) central portion of the angle irons 60, said openings being parallel to one another and arranged one above the other.

Figure 5A:
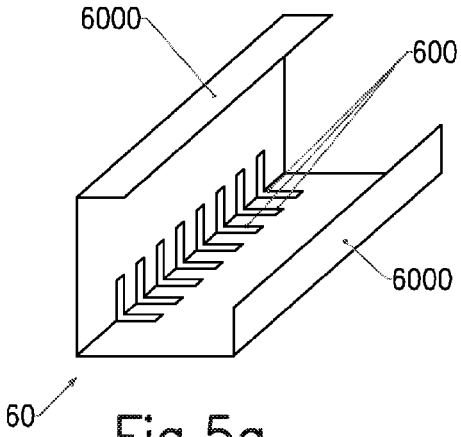
FIG. 5*a* is a perspective schematic view of a first embodiment of an angle iron.
Figure 5B:
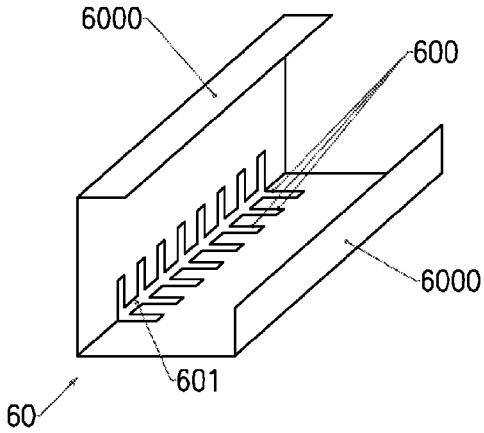
FIG. 5*b* is a perspective schematic view of a second embodiment of an angle iron.

Referring to FIGS. 5*a* and 5*b*, each opening 600 is extended on either side of the central portion of the angle irons 60. This type of opening 600 is particularly designed to receive plates 40 as represented in FIG. 1*a*. In a variant embodiment represented in FIG. 5*c*, each opening 600 is extended only on one side of the central portion of the angle irons 60, said openings being staggered, that is to say, being alternated on one side or the other of said central portion. This type of opening 600 is particularly intended to receive plates 40 as represented in FIG. 1*b*. It should however be noted that the plates 40 represented in FIG. 1*b* may also be positioned in the angle irons 60 represented in FIGS. 5*a* and 5*b*. In the latter case, the lips of the edges 41 being offset in space, they fit alternately into the openings 600, but only on one side or the other of the central portion of the angle irons 60. The portion of the openings 600 which will not receive the lips of the edges 41 will then be blocked, for example by welding.

Each opening 600 is in fact intended to receive two edges 41 which are superposed following the juxtaposition of two plates 40 (FIG. 7). The openings 600 therefore have, in principle, a thickness equal to the thickness of two superposed edges 41, or even slightly greater, to facilitate the fitting. In practice, the openings 600 are dimensioned so as to exactly receive the edges 41, with a play preferentially being provided to facilitate the fitting.

When the edges 41 are positioned in the openings 600, the end of said edges is flush with the internal surface of the angle irons 60. The ends of the edges can thus be easily welded in the openings 600. Referring to FIG. 3, weld beads 70 are therefore produced in line with the openings 600. These welds 70 ensure not only the seal-tightness of the plates 40 at its corners, but also the mechanical bond between said plates and the angle irons 60 so as to produce a rigid module 1.

Referring to FIGS. 3 and 7, a vertical weld bead 71 can be produced along at least one of the outer lips of each angle iron, at the level of the plates 40, so as to ensure a seal-tightness between the fluid circuits, that is to say, between the various chambers 202, 212, 222, 232.

Figure 5C:
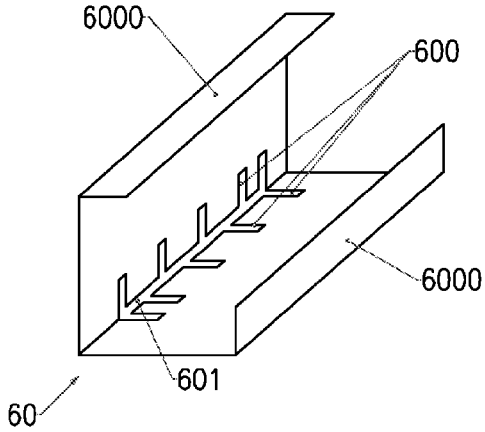
FIG. 5*c* is a perspective schematic view of a third embodiment of an angle iron.

In a variant embodiment, the vertical weld bead can be produced inside the angle irons 60, along their central angular (or beveled or circular) portion. For this, angle irons 60 as represented in FIGS. 5*b* and 5*c* will preferentially be used, that is to say, angle irons that include a longitudinal opening 601 in their central angular (or beveled or circular) portion. The vertical weld bead ensuring the seal-tightness between the fluid circuits will be produced in this longitudinal opening 601, outside said fluid circuits. Since the welds are not in direct contact with the fluids, this solution is particularly advantageous in the case where the fluids are aggressive. Furthermore, it is commonplace for the welding operations to produce spatter likely to affect the substance of the plates 40 and cause incipient rusting in the exchange zone. The solution consisting in producing the welds outside the fluid circuits makes it possible to remedy this state of affairs by protecting the plates 40 and by preserving the exchange zone.

It is therefore now the angle irons 60 which ensure the segregation between the two fluid circuits, unlike the exchanger described in the patent document FR 2.562.997 (VICARS) in which it is the rails which provide this function.

As mentioned previously, the vertical angle irons 60 are intended to receive the vertical rails 10. The angle irons 60 therefore in practice have a profile complementing that of the rails 10. It may be advantageous to provide the sides of the angle irons 60 with vertical fins 6000 (FIGS. 5*a*, 5*b* and 5*c*) configured to keep the rails 10 inside said angle irons. Referring to FIGS. 3 and 7, a seal 80, made of PTFE or graphite, is positioned between the side walls 20, 21, 22, 23 of the chamber and the portion of the angle irons 60 facing said walls. In this way, when the side walls 20, 21, 22, 23 are fixed to the rails 10, the seals 80 are crushed and ensure the seal-tightness of the chambers 20, 21, 22, 23. The vertical fins 6000 also define the reach of the seals 80.

Figure 4:
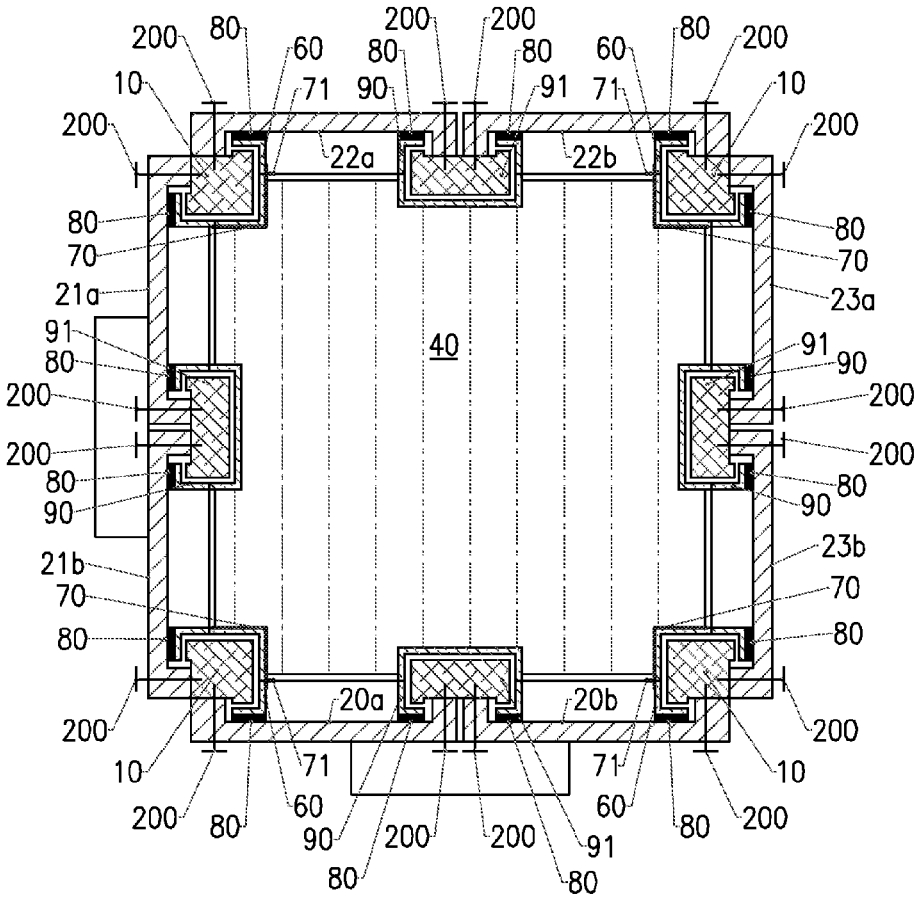
FIG. 4 is a horizontal cross-sectional view of an exchanger conforming to the invention, in a variant embodiment in which large-size plates are used.
Figure 9A:
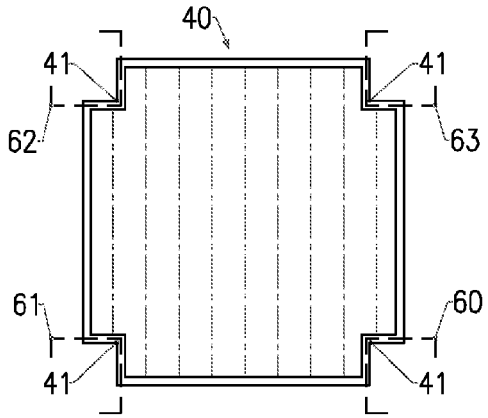
Figure 9B:
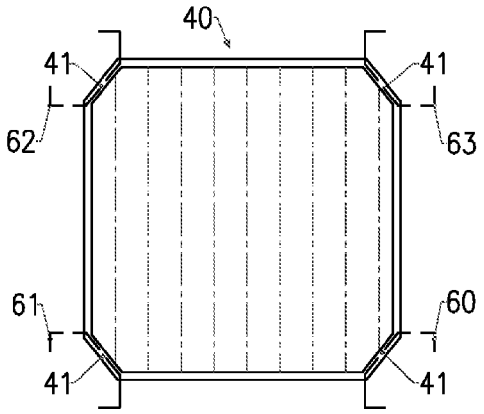
Figure 9C:
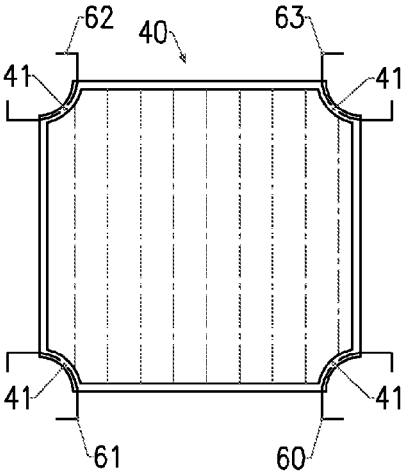
Figure 9D:
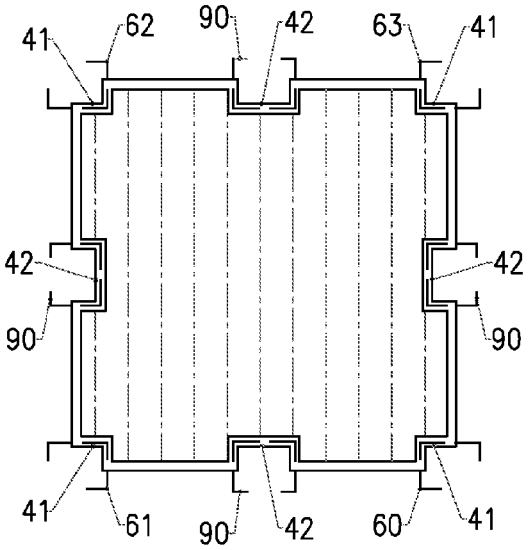

For large size plates 40, such as those represented in FIGS. 4 and 9*d*, lips of said plates are preferably provided with one or more additional horizontal edges 42. In practice, only the lips that have a length greater than a value determined by those skilled in the art, for example greater than 1 m, can be provided with these additional edges 42 in their middle. Depending on the length of the lips of the plate 40, it is possible to provide a number of additional horizontal edges 42. For example, for the plates having a length of 2 m, two additional edges 42 can be provided on each lip. These additional horizontal edges 42 may be in the form of a U oriented toward the interior of the plate 40 (FIG. 9*d*) or have a circular (or semi-circular) shape oriented toward the interior of said plate, or any other shape agreeable to those skilled in the art. They have the same width and the same thickness as the corner edges 41. The additional edges 42 are easily obtained when stamping the plates 40.

Figure 6:
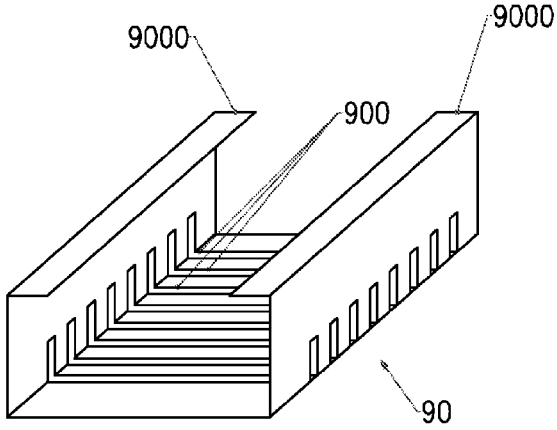
FIG. 6 is a perspective schematic view of an embodiment of an angle iron intended to be arranged at the level of the lips of large-size plates.

Referring to FIG. 4, the additional edges 42 are intended to fit into horizontal openings 900 formed on additional vertical angle irons 90. Additional rails 91 are then inserted into these additional angle irons 90. Referring more particularly to FIG. 6, these additional angle irons 90 are in the form of one-piece metal profile sections, having substantially the general shape of the additional edges 42, that is to say, having a U, circular or similar shape. As for the angle irons 60, the openings 900 are parallel to one another, arranged one above the other and have the same thickness as the openings 600. In practice, the openings 900 are dimensioned so as to exactly receive the additional edges 42, with a play preferentially being provided to facilitate the fitting. When the additional edges 42 are positioned in the openings 900, the end of said edges is flush with the internal surface of the additional angle irons 90. The ends of the edges 42 can thus easily be welded in the openings 900. Weld beads 901 are produced in line with the openings 900 to ensure the mechanical bond between the plates 40 and the additional angle irons 90. It is also possible, but not necessary, to envisage producing a vertical weld bead along at least one of the external lips of each additional angle iron 90, at the level of the plates 40.

As mentioned previously, the additional vertical angle irons 90 are intended to receive the additional vertical rails 91. The additional angle irons 90 therefore in practice have a profile complementing that of the rails 91. It may be advantageous to provide the sides of the angle irons 90 with vertical fins 9000 (FIG. 6) configured to keep the rails 91 inside said angle irons. Referring to FIG. 4, at the level of each of the lips provided with the angle irons 90, the chamber of the exchanger can be closed by two side walls, respectively 20*a*-

20*b*, 21*a*-21*b*, 22*a*-22*b* and 23*a*-23*b*, each fixed to a corner rail 10 and to an additional vertical rail 91 by means of screws 200, bolts, or in any other manner agreeable to those skilled in the art. If a number of additional angle irons are provided on one and the same plate lip, other side walls can be fixed to the additional vertical rails inserted into said angle irons. As described previously, a seal 80, made of PTFE or graphite, is positioned between the side walls of the chamber and the portion of the additional angle irons 90 facing said walls. The vertical fins 9000 also define the reach of the seals 80.

In practice, the side walls 20*a*, 20*b*, 21*a*, 21*b*, 22*a*, 22*b*, 23*a*, 23*b* are metal plates that have a thickness varying from 50 mm to 200 mm depending on the pressure of the fluids. Without the additional edges 42 and the additional angle irons 90, it would be necessary to provide one-piece side walls linking each angle iron, said walls necessarily having a greater thickness to withstand the pressure of the fluids. The technical solution proposed by the invention therefore makes it possible to significantly reduce the thickness of the side walls of the exchanger.

The additional edges 42 and the additional angle irons 90 can also be provided on exchangers of small or standard size, for example exchangers consisting of plates 40 having a length of approximately 30 cm, but subject to significant pressures (from around 35 bar to 40 bar). This design will contribute to the rigidity of the assembly by preventing the plates from separating locally from one another under the effect of the pressure.

The invention claimed is:

1. A heat exchanger comprising:

a plurality of vertical angle irons, each vertical angle iron comprising an one-piece metal profile and defining an internal surface and having horizontal openings;

a plurality of vertical rails inserted into the vertical angle irons;

a closed chamber defining side walls delimiting the closed chamber, the side walls being fixed to the vertical rails;

a plurality of welded plates, inside the closed chamber, the welded plates being superposed and alternated and stacked one above the other, the plates defining between them interpenetrating independent circuits configured to have fluids flowing therein, each plate having ribs configured so as to form, when the plates are stacked, independent and interpenetrating ducts, in which hot and cold fluids flow, each plate including a plurality of corners, each corner including a horizontal edge, wherein:

each vertical angle iron has a central portion defining a bend formed vertically along the one-piece metal profile, each bend having a shape corresponding to the shape of the horizontal edges, the horizontal openings being formed at the level of the central portion of the angle irons;

a horizontal edge of a first corner of a first plate, of the plurality of plates, fits into a first horizontal opening of a first angle iron, of the plurality of angle irons, such that an end of the horizontal edge of the first corner of the first plate is flush with the internal surface of the first angle iron, a horizontal edge of a second corner of the first plate fits into a first horizontal opening of a second angle iron, of the plurality of angle irons, such that an end of the horizontal edge of the second corner of the first plate is flush with the internal surface of the second angle iron, and a horizontal edge of a third corner of the first plate fits into a first horizontal opening of a third angle iron, of the plurality of angle irons, such that an end of the horizontal edge of the third corner of the first plate is flush with the internal surface of the third angle iron; and a plurality of weld beads, in line with the horizontal openings, to facilitate mechanical bonding between the edges of the plates and the angle irons.

2. The exchanger as claimed in claim 1, in which each central portion of the angle irons has a central square, bevel or circular shaped portion formed along the bend of the one-piece metal profile, the horizontal openings being produced in the central angular, beveled or circular portion of the angle irons, the horizontal openings being parallel to one another and arranged one above the other.

3. The exchanger as claimed in claim 2, in which the horizontal openings are staggered.

4. The exchanger as claimed in claim 1, in which the horizontal edges are welded into the horizontal openings of the angle irons.

5. The exchanger as claimed in claim 1, in which a vertical weld bead is formed along an outer lip of each angle iron, at the level of the plates, so as to ensure a seal-tightness between the fluid circuits.

6. The exchanger as claimed in claim 2, in which a vertical weld bead ensuring the seal-tightness between the fluid circuits is formed inside the angle irons, along their central angular, beveled or circular portion, the angle irons including a longitudinal opening in their central angular, beveled or circular portion, the weld bead being formed in this longitudinal opening, outside the fluid circuits.

7. The exchanger as claimed in claim 1, wherein the first plate includes another edge, the another edge being located between the first and second corners of the first plate, the another edge fitting into an opening of another angle iron, of the plurality of angle irons, another vertical rail, of the plurality of vertical rails being inserted into the another angle iron, a side wall being fixed to the another vertical rail.

8. The exchanger as claimed in claim 7, in which the another edge and the opening of the another angle iron are horizontal.

9. The exchanger as claimed in claim 1, in which the chamber is provided with a top cover and a bottom cooperating in a seal-tight manner with the side walls, the cover being equipped with orifices for bleeding air and the bottom being equipped with orifices for bleeding the fluids in the independent circuits.

10. The exchanger of claim 1 wherein the horizontal edge of the first corner of the first plate defines a gap that fits into the first horizontal opening of the first angle iron.

11. The exchanger of claim 10 wherein the gap has a corner shape.

12. The exchanger of claim 10 wherein the gap has a bevel shape.

13. The exchanger of claim 10 wherein the gap has an arc shape.

14. The exchanger of claim 10 wherein a horizontal edge of a first corner of a second plate, of the plurality of plates, fits into the first horizontal opening of the first angle iron.

15. The exchanger of claim 14 wherein the horizontal edge of the first corner of the first plate defines a gap that fits into the first horizontal opening of the first angle iron.

16. The exchanger of claim 15 wherein the gap has a corner shape.

17. The exchanger of claim 15 wherein the gap has a bevel shape.

18. The exchanger of claim 15 wherein the gap has an arc shape.

* * * * *